US008617638B2

(12) United States Patent
Hill

(10) Patent No.: US 8,617,638 B2
(45) Date of Patent: Dec. 31, 2013

(54) METHOD OF MANUFACTURING PHOTOLUMINESCENT PAVERS AT A PAVER MANUFACTURING FACILITY

(76) Inventor: Dennis Michael Hill, St. Clair, MI (US)

( * ) Notice: Subject to any disclaimer, the term of this patent is extended or adjusted under 35 U.S.C. 154(b) by 442 days.

(21) Appl. No.: 12/766,406

(22) Filed: Apr. 23, 2010

(65) Prior Publication Data

US 2011/0262635 A1 Oct. 27, 2011

Related U.S. Application Data

(63) Continuation-in-part of application No. 12/765,087, filed on Apr. 22, 2010, now Pat. No. 8,393,676.

(51) Int. Cl.
*B05D 5/06* (2006.01)

(52) U.S. Cl.
USPC ..... 427/64

(58) Field of Classification Search
USPC ..... 427/64
See application file for complete search history.

(56) References Cited

U.S. PATENT DOCUMENTS

| | | | |
|---|---|---|---|
| 604,658 | A | 5/1898 | Forster |
| 948,770 | A | 2/1910 | Price |
| 1,078,810 | A | 11/1913 | Van Derveer |
| 1,626,095 | A | 4/1927 | Ramsburg |
| 1,756,351 | A | 4/1930 | Gentile |
| 1,862,382 | A | 6/1932 | Mathis |
| 1,886,988 | A | 11/1932 | Thelen |
| 2,659,422 | A | 11/1953 | Holland |
| 3,756,657 | A | 9/1973 | Johnson |
| 4,600,251 | A | 7/1986 | Zimmerman |
| 5,292,221 | A | 3/1994 | Fenander |
| 6,090,324 | A | 7/2000 | Keady |
| 6,136,226 | A | 10/2000 | Sakai |
| 6,309,562 | B1 | 10/2001 | Sakai et al. |
| 6,413,007 | B1 | 7/2002 | Lambright |
| 6,500,543 | B2 | 12/2002 | Sakai |
| 6,599,444 | B2 | 7/2003 | Burnell-Jones |
| 6,627,315 | B2 | 9/2003 | Sakai |
| 6,665,986 | B1 | 12/2003 | Kaplan |
| D484,714 | S | 1/2004 | Que |
| 6,887,010 | B2 | 5/2005 | Mayer Rodis |
| 7,066,680 | B2 | 6/2006 | Wiley |
| 7,074,345 | B2 | 7/2006 | Saito et al. |
| 7,364,615 | B1 | 4/2008 | Bryant |
| 7,371,441 | B2 | 5/2008 | Sakai et al. |
| 2003/0146534 | A1 * | 8/2003 | Chutich et al. ..... 264/75 |

(Continued)

OTHER PUBLICATIONS

Reckli GmbH—"Photo-Engraving Formliners" download, website: http://www.reckli.net/foto-gravur-matrizen.html?&L=5; dated Jan. 2009.

*Primary Examiner* — Robert Vetere
(74) *Attorney, Agent, or Firm* — Brooks Kushman P.C.

(57) ABSTRACT

A method is disclosed of manufacturing photoluminescent paving blocks or pavers at a paver manufacturing facility. A curable paver composition is provided at a mixing station for mixing. The mixed composition is shaped into uncured pavers having upper surfaces at a forming station. A curable liquid coating composition is applied to the upper surfaces of the uncured pavers at one or more coating stations. The uncured pavers and the coating composition applied thereon are heated in a kiln at a curing station to cure the uncured pavers. After leaving the kiln, the coating composition is cured to form a photoluminescent pigment layer having a binder with photoluminescent particulate pigment essentially uniformly dispersed in the binder and an optically transmissive clear coat layer in overlying relationship with the pigment layer.

16 Claims, 2 Drawing Sheets

(56) References Cited

U.S. PATENT DOCUMENTS

| | | | | |
|---|---|---|---|---|
| 2005/0160637 | A1 | 7/2005 | Hesse | |
| 2005/0161985 | A1 | 7/2005 | Austin | |
| 2006/0162620 | A1 | 7/2006 | Horton, Jr. et al. | |
| 2007/0248836 | A1 | 10/2007 | Linde | |
| 2008/0072531 | A1* | 3/2008 | Oliveira | 52/745.06 |
| 2008/0131203 | A1* | 6/2008 | Colletti | 404/73 |
| 2008/0217584 | A1* | 9/2008 | Sturley | 252/301.36 |
| 2009/0262514 | A1 | 10/2009 | Sturley | |
| 2009/0265979 | A1 | 10/2009 | Spittle et al. | |
| 2009/0302760 | A1 | 12/2009 | Tchakarov et al. | |

* cited by examiner

METHOD OF MANUFACTURING PHOTOLUMINESCENT PAVERS AT A PAVER MANUFACTURING FACILITY

CROSS-REFERENCE TO RELATED APPLICATIONS

This application is a continuation-in-part application of U.S. patent application entitled "Decorative Bench Or Seat Assembly Having A Photoluminescent Work Bonded Thereto", filed Apr. 22, 2010, and having U.S. Ser. No. 12/765,087 now U.S. Pat. No. 8,393,676.

BACKGROUND OF THE INVENTION

1. Field of the Invention

This invention relates to methods of manufacturing pavers and, in particular, to methods of manufacturing photoluminescent pavers at a paver manufacturing facility.

2. Background Art

Paving blocks (i.e. pavers) are used for walkways, driveways and paths. The paving blocks allow ground motion without cracking which commonly occurs with concrete slabs and can be laid in various patterns that are aesthetically pleasing. Walkway lighting has long been used along with such paving blocks to increase safety and make for more sure footing or parking. Because the majority of walkway lighting is wired with low voltage electricity, there are electrical consumption costs associated with the use of such a system and difficulties in setup if the walkway is a long one or is located at a distance from an electrical outlet.

As described in U.S. Pat. No. 5,292,221, in automated brick or block making plants, a block machine presses moldable product into a block mold to produce green or uncured blocks. The green blocks are transported to kilns for curing and are thereafter palletized for shipment from the plant.

The block molding machine may dispense a plurality of green blocks on a rectangular metal pallet. The pallets are transported by conveyor to a stacker tower which receives the pallets, one at a time. After a pallet is received by the stacker at the level of the conveyor, the stacker shifts the pallet upwardly and then receives another pallet loaded with block directly therebeneath. This process continues until a vertical stack of pallets are held by the stacker.

The stacker is positioned adjacent a device known as a loader. The loader comprises a vertically-shiftable spade assembly from which a plurality of spades, positioned one above the other, extend laterally. There are the same number of spades in the loader as pallets with the spades being spaced apart from one another the same distance as the pallets in the stacker.

In operation, when the stacker is filled with loaded pallets, the loader carriage drives the spade assembly toward the stacker until each spade is received just beneath a corresponding pallet. One of the rams on the spade assembly actuates to shift the spades upwardly thereby lifting the pallets. The carriage then withdraws from the stacker, rotates 180° and advances toward a rack positioned at the other end of the spade assembly travel path. The carriage moves the spade assembly bearing the loaded pallets into the rack and a ram on the spade assembly actuates thereby lowering the assembly and depositing the stacked pallets on the rack.

Thereafter, either by way of a forklift or on automated transport cars, the racks are moved into kilns for curing.

After the blocks are cured, the racks are removed from the kilns and transported to a second stacker and unloader which operate in reverse fashion from the stacker and loader as described above and are referred to as an unloader and unstacker. The unloader carriage moves toward the rack bearing the cured block and positions a spade under each pallet. The ram on the spade assembly actuates thereby raising the spade assembly and the corresponding pallets which are then transported laterally by the unloader carriage toward the unstacker. Prior to reaching the unstacker the spade rotates 180° and thereafter drives into the unstacker and deposits the pallets thereon. The unstacker lowers each pallet, one at a time, onto a conveyor which transports the cured block to a palletizing station prior to shipment.

U.S. Pat. No. 6,665,986 discloses a phosphorescent paving block having a paving base, and a phosphorescent material in contact with the paving base. Additionally, the paving block can also have a light-transmitting cover and a light-transmitting base on either side of the phosphorescent material to form a laminate.

U.S. published patent application 2009/0262514 discloses a path marking system comprising a substrate defining cavity. A photoluminescent insert comprises a first resinous layer that is cast with photoluminescent particles suspended therein. Adhesive attaches the photoluminescent insert inside of the cavity. A marking device comprises a photoluminescent insert comprising cast resinous layers. A first one of the cast resinous layers includes photoluminescent particles suspended therein. A fastener includes a first portion cast in the photoluminescent insert and a second portion extending outside of the photoluminescent insert.

Other related U.S. patent documents include the following: 2007/0248836; 2009/0302760; 2009/0265979; 2005/0160637; 2006/0162620; U.S. Pat. Nos. 7,371,441; 6,627,315; 6,500,543; 7,066,680; 7,074,345; 6,309,562; 6,136,226; and 6,599,444.

U.S. patent publication 2008/007253 discloses a method and system for producing coated ballast pavers. A concrete mixture is shaped into uncured pavers. A reflective coating is applied to the top surface of the pavers. The uncured pavers and the coating are heated in a kiln to cure the concrete mixture and the reflective coating.

U.S. Pat. No. 7,364,615 discloses a method of forming pavers containing waste glass particles.

SUMMARY

An object of at least one embodiment of the present invention is to provide a low cost method of mass producing photoluminescent pavers without extensive redesign of conventional paver manufacturing facilities.

In carrying out the above object and other objects of at least one embodiment of the present invention, a method of manufacturing photoluminescent pavers at a manufacturing facility is provided. The method includes providing a curable paver composition. The method further includes forming a plurality of uncured pavers from the curable paver composition. Each of the pavers has an upper surface. The method still further includes applying a curable liquid coating composition to the upper surfaces. The method further includes heating the uncured pavers in a kiln to form cured pavers wherein the applied liquid coating composition is substantially cured upon removal of the cured pavers from the kiln and wherein the cured coating composition includes a photoluminescent pigment layer having a binder with photoluminescent particulate pigment essentially uniformly dispersed in the binder and an optically transmissive clear coat layer in overlying relationship with the pigment layer.

The step of applying may include the steps of coating each of the upper surfaces with the binder to form a film, coating the outer surface of each of the films with the photoluminescent particulate pigment and coating the photoluminescent particulate pigment on each of the films with the clear coat.

The clear coat layer may be a sealer.

The binder may be a sealer such as an acrylic-based clear sealer.

The method may include the step of providing a conveyor that carries the uncured pavers and the step of applying may be performed while the uncured pavers are carried by the conveyor.

The step of applying may include the steps of providing at least one spray nozzle, spraying the binder through the at least one spray nozzle, providing at least one powder coating device and dispensing the photoluminescent particulate pigment through the at least one powder coating device.

The at least one powder coating device may include at least one powder coating spray gun.

The curable paver composition may include concrete.

Further in carrying out the above object and other objects of the present invention, a method of manufacturing both photoluminescent and non-photoluminescent pavers is provided. The method includes providing a curable paver composition. The method further includes forming first and second sets of uncured pavers from the curable paver composition. Each of the uncured pavers has an upper surface. The method still further includes applying a curable liquid coating composition to the upper surfaces of the first set of the uncured pavers. The method further includes heating the first set of uncured pavers in a kiln to form cured pavers. The applied liquid coating composition is substantially cured upon removal of the cured pavers from the kiln. The cured coating composition includes a photoluminescent pigment layer having a binder with photoluminescent particulate pigments essentially uniformly dispersed in the binder and an optically transmissive clear coat layer in overlying relationship with the pigment layer to form the photoluminescent pavers. The method still further includes heating the second set of uncured pavers in the kiln to form cured non-photoluminescent pavers.

The step of applying may include the steps of coating the upper surfaces of each of the first set of uncured pavers with the binder to form a film, coating the outer surface of each of the films with the photoluminescent particulate pigment and coating the photoluminescent particulate pigment on each of the films with the clear coat.

The clear coat may be a sealer.

The binder may be a sealer such as an acrylic-based clear sealer.

The method may further include the step of providing a conveyor that carries the first set of uncured pavers and the step of applying may be performed while the first set of uncured pavers are carried by the conveyor.

The step of applying may include the steps of providing at least one spray nozzle, spraying the binder through the at least one spray nozzle, providing at least one powder coating device and dispensing the photoluminescent particulate pigment through the at least one powder coating device.

The at least one powder coating device may include at least one powder coating spray gun.

The curable paver composition may include concrete.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENTS

Figure 1:
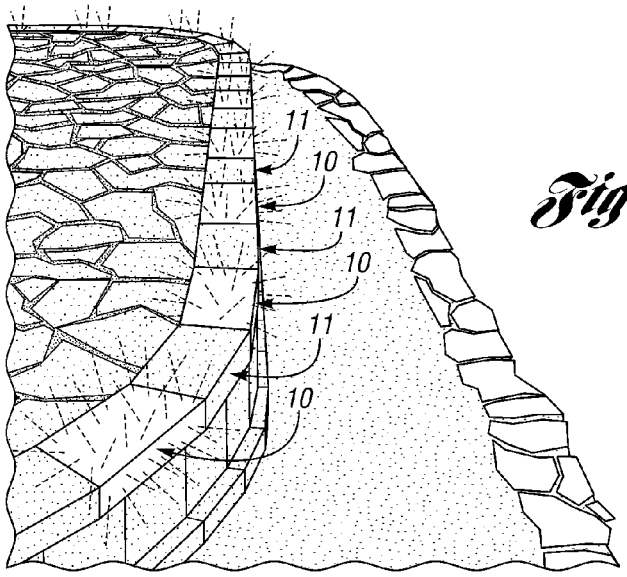
FIG. 1 is an environmental view showing the use of photoluminescent and non-photoluminescent pavers made in accordance with at least one embodiment of the present invention.
Figure 2:
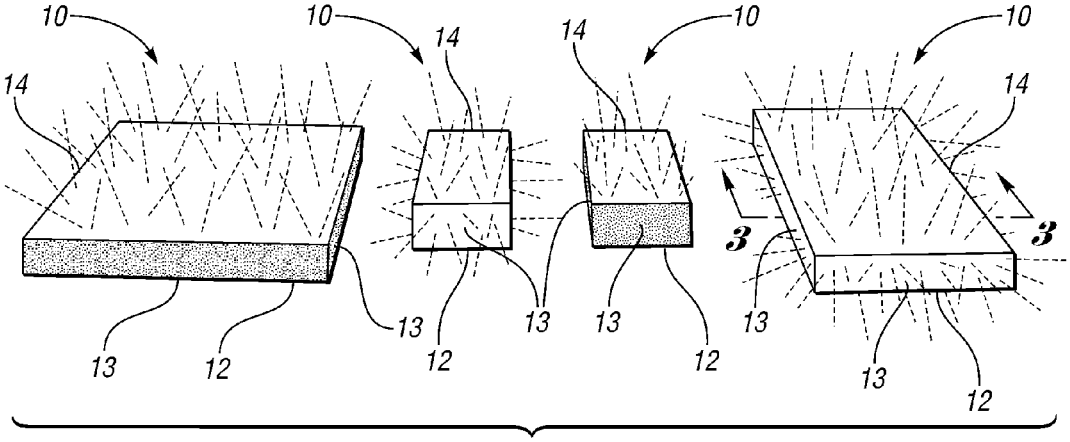
FIG. 2 is a perspective view of different sized photoluminescent pavers manufactured in accordance with at least one embodiment of the present invention.
Figure 3:
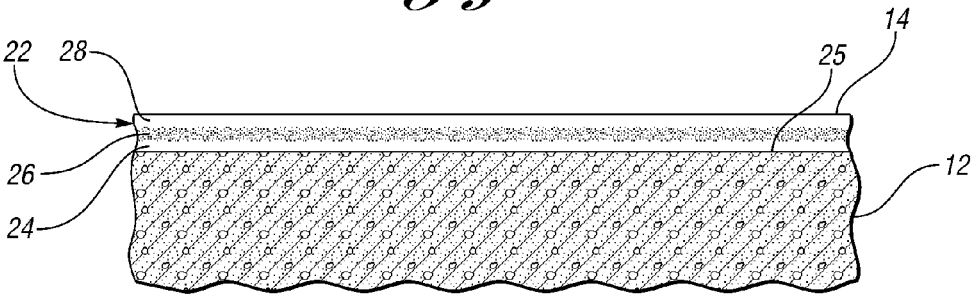
FIG. 3 is an enlarged view, partially broken away and in cross-section, taken along lines 3-3 of FIG. 2.

As shown in FIGS. 1 and 2, exemplary photoluminescent pavers made in accordance with at least one embodiment of the method of the present invention is indicated generally by reference numeral 10. Exemplary non-photoluminescent pavers made in accordance with at least one embodiment of the present invention are generally indicated at 11. Each photoluminescent paver 10 is generally described as a low-profile rectangular block having a body 12 including side surfaces 13, a top surface 14, and an opposed bottom surface. It should be appreciated that various paver configurations may be used. For example, the photoluminescent pavers 10 may be any size or shape and may or may not include overlaying features to provide interlocking capabilities.

The top surface 14 of each of the photoluminescent pavers 10 includes a coating, generally indicated at 22, which may also be referred to as a multi-layer film, that is adapted to provide photoluminescence. In other words, the film 22 provides luminescence in response to excitation by light. The coating 22 gives off light caused by absorption of radiant energy provided by the sun. The coating 22 may be provided over substantially the entire top surface 25 of an uncured paver. The coating 22 gives off light when exposed to sunlight. The coating 22 may have a color but preferably is clear.

The coating 22 includes a bottom layer 24, a middle layer 26 and a top layer 28. The middle layer 26 is a photoluminescent pigment layer having a binder with photoluminescent particulate pigment essentially uniformly dispersed therein. The top layer 28 is an optically transmissive clear coat layer in overlying relationship with the pigment layer. The bottom or binder layer binds the other layers 26 and 28 to the top porous surface of the paver body 12.

Figure 4:
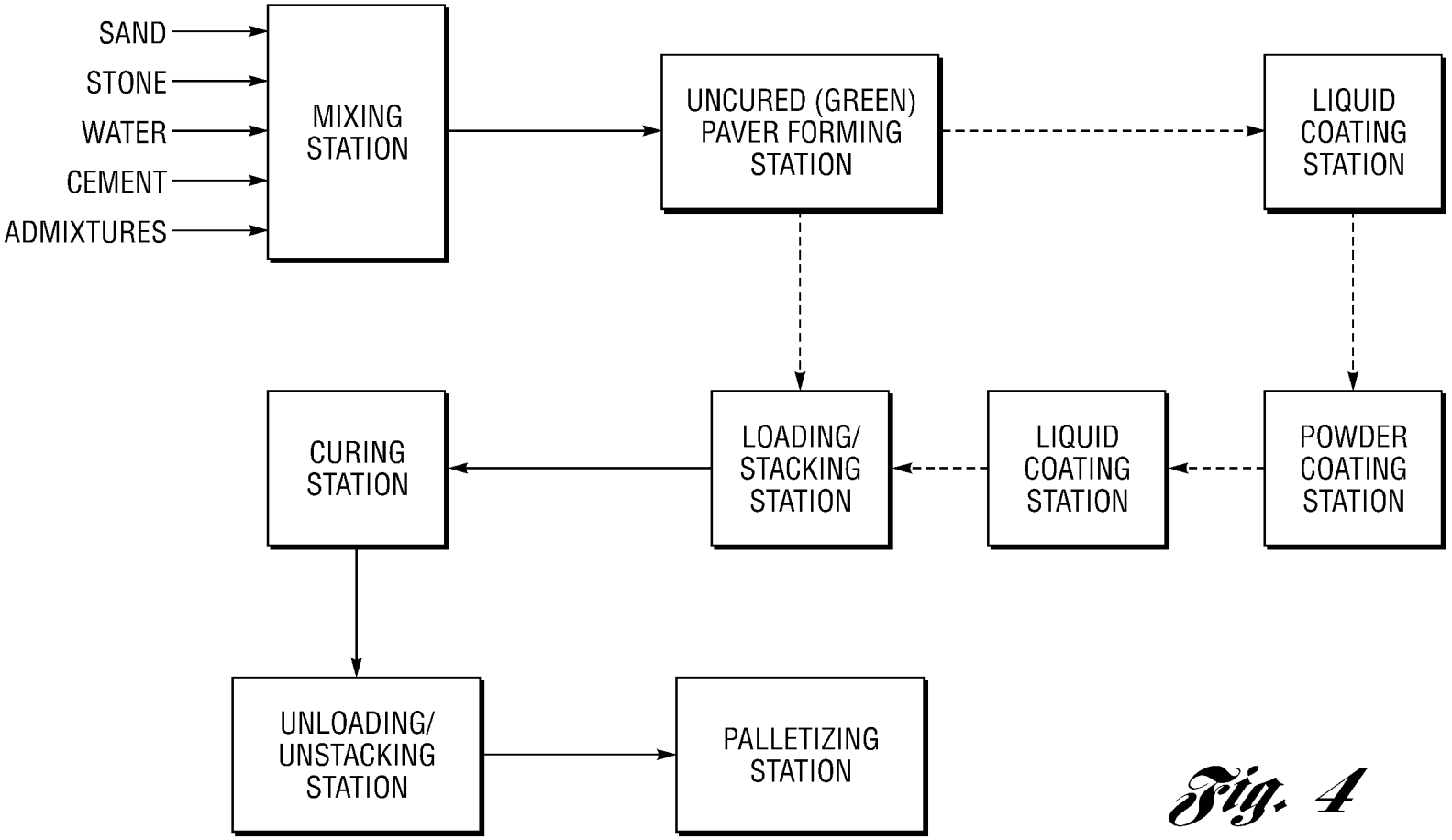
FIG. 4 is a block diagram flow chart showing an exemplary method of making the pavers shown in FIGS. 1-3.

The photoluminescent coated paver 10 may be formed according to a method described with reference to FIG. 4. The method disclosed is advantageous as compared to prior art methods in that it allows for continuous production of the photoluminescent pavers. This continuous production method, which includes applying the coating composition to the paver prior to shipment, is more efficient and may be used to produce large quantities of photoluminescent pavers which are ready to be installed.

In a first step, a curable paver composition or mixture is provided to a mixing station which may include a mixing drum. The mixture may include sand, stone, water, cement and admixtures. The curable paver composition may be any composition that, when cured or otherwise solidified, provides sufficient weight and strength to withstand conditions in a paving environment. The curable paver composition may be any inorganic curable composition. Cements typically include mixtures of lime, and/or alumina, and/or silica. The curable paver composition may be concrete wherein an aggregate such as stone may be embedded in a matrix of mortar or cement.

The blended mix is then typically transferred by a conveyor belt to a molding machine at a forming station. The molding machine molds, vibrates and compresses the mix into the desired shape and density of the paver. In other words, the curable paver composition is shaped at the forming station into an uncured paver. The curable paver composition remains wet (or green) and thus may be shaped or otherwise processed into a desired final shape. The uncured paver may be shaped in a mold or may be shaped on an open tray. The curable paver composition exhibits sufficient physical integrity to self-sustain its shape.

The uncured pavers may be any shape as shown in FIG. 2 but may include portions adapted to interlock with adjoining photoluminescent or non-photoluminescent pavers when installed in a paver application or environment such as illustrated in FIG. 1. The uncured pavers may be shaped to include portions that may overlap adjoining pavers when installed. The uncured pavers may be shaped into low-profile, generally rectangular or square forms. The uncured pavers typically include at least one major porous top surface.

In a next step for forming the photoluminescent pavers, a curable liquid coating in the form of a curable binder is applied to the uncured paver at a first liquid coating station. If non-photoluminescent pavers are to be manufactured, the coating stations are skipped and the uncured pavers go directly to a loading/stacking station. The uncured pavers are typically transferred from the forming station to the coating station by a conveyor. The coating may be applied on substantially the entire porous top surface of the uncured paver. In other embodiments, the coating may be applied to both the top and at least one side surface. In other embodiments, the coating is applied to the top and each side surface. In still other embodiments, the coating may be applied to the top major surface and to any interlocking or overlapping portions. The binder penetrates the porous surfaces of the pavers and when cured forms the bottom layer 24.

The binder may be applied by using various methods. For example, the coating may be sprayed onto the uncured pavers by means of spray nozzles. In other embodiments, the coating composition may be applied by rolling or brushing the liquid coating composition onto the uncured pavers. In other embodiments, the coating composition can be knife coated on the uncured pavers.

In a next step, a powder coating in the form of a photoluminescent particulate pigment is coated on the outer surface of the binder film layer 24 at a powder coating station. The particulate pigment may also be applied using various methods. For example, the powder coating may be dispensed by powder coating devices such as spray guns. The powder coating devices dispense air fluidized powder coating material made up of air and airborne power coating material from an air fluidized powder feeding device connected to the coating devices.

Powder coatings are commonly applied to objects by powder spray guns that may be operated either manually or automatically. In an automatic system, one or more spray guns are controlled to spray powder onto the objects as the objects are conveyed past the guns. In a manual gun operation, typically each paver is suspended or otherwise positioned near a spray gun and the operator controls when the gun starts and stops spraying. A powder spray gun may be selected from a wide variety of gun designs. Since a powder spraying operation is intended to coat an object evenly, a common technique for spraying powder is to apply an electrostatic charge to the powder particles (i.e. particulate pigments) which causes the powder to better adhere to the paver and also results in a more uniform application. Electrostatic powder spray guns include corona guns and other types of guns.

In a next step, another liquid coating in the form of a clear binder or sealer is applied on top of the particulate pigment at a second liquid coating station. The uncured pavers are typically transferred between the coating stations by a conveyor. The second liquid coating may be applied on substantially the entire powder coating to complete the middle layer 26 and to form a clear coat top layer 28.

The second liquid coating or binder may be applied by using various methods. For example, the coating may be sprayed onto the particulate pigment by means of liquid spray nozzles. In other embodiments, the coating composition may be applied by rolling or brushing the liquid coating composition onto the particulate pigment. In other embodiments, the coating composition can be knife coated on the particulate pigment.

The uncured pavers with or without the curable liquid coating composition thereon are then loaded and/or stacked at a stacking station. The pavers may be on individual racks or may be stacked on top of each other. The pavers then travel on a pallet by a chain drive system and are stacked by a spade into racks. An automated car on tracks moves the racks into a kiln or a kiln system at a curing station.

Conditions are provided to allow the curable liquid coating composition to coextensively cure with the uncured pavers at the curing station. The coated, uncured pavers are cured in the kiln wherein the temperature is elevated above ambient temperature. The coated, uncured paver may also be cured in ambient conditions. In any event, after conditions for cure are provided, the resulting cured pavers include a photoluminescent coating or multi-layer film. The pavers and associated coating advantageously exhibit sufficient strength to withstand conditions in a paver environment. The photoluminescent coating adheres to the paver body and resists chipping, cracking and flaking.

Typically, the kiln system includes a large room kept at about 100 degrees F. Once the pavers are cured, the racks on which the pavers are supported are removed from the kiln by the automated car and taken to an unloading spade at an unloading unstacking station. The unloading spade typically goes to a line of elevated rollers. Since the coated pavers are fully cured, they may go on rollers straight outside the manufacturing facility to storage.

A plurality of coated pavers may be bundled and transported to a paver site. A plurality of coated pavers may be stacked on a pallet at a palletizing station. The stacked coated pavers may be secured to the pallet with wrapped plastic film. The stacked coated pavers may be secured using a plurality of straps. In any event, a plurality of coated pavers are grouped and transported to a paver site.

In certain embodiments, the coating composition may not require heating to cure and, depending upon the coating used, may cure in ambient atmospheric conditions. In such embodiments, the coating composition may be applied after the uncured paver is cured, but while at the manufacturing facility where the paver is manufactured. Application of coating composition prior to placement in the kiln may, however, advantageously decrease process time because the coating composition and concrete mixture cure simultaneously. For example, if the coating material is applied after curing the curable paver composition in the kiln, additional time must be given to allow the coating to cure prior to stacking and bundling for shipment. This additional time is eliminated by applying the coating composition prior to curing within the kiln. Accordingly, at least one technical advantage of the above disclosed process resides in the fact that the coating composition is applied to the uncured pavers prior to curing the pavers within the kiln.

Many advantages are realized by practicing the above disclosed method. Notably, a greater coating uniformity is achieved as compared to prior art methods. This in turn results in greater photoluminescent levels, less wasted binder and photoluminescent particulate pigment and greater durability. Further, because coating 22 is applied during manufacture, contamination is greatly controlled, resulting in better adhesion and coverage. Finally, by pre-applying coating 22, the costly and time consuming step of on-site coating is eliminated. This results in reduced cost and construction time.

The photoluminescent coating composition cures, hardens and/or dries into a cured coating or multi-layer film that adheres to the paver body 12. The coating composition provides a coating that is resistant to chipping, flaking or cracking due to thermal or physical stresses. The coating composition provides a coating that absorbs sunlight. The binder of the coating composition is substantially clear.

The photoluminescent particulate pigment of the coating composition is a light absorbing material. In these or other embodiments, the coating composition includes a light absorbing photoluminescent filler or particulate pigment. The coating composition also includes a binder and/or a matrix.

The coating composition employed in one or more embodiments of the present invention includes a photoluminescent particulate pigment and a binder. The pigment, which may also be referred to as a filler, includes photoluminescent particulate pigments. These pigments absorb light during daytime conditions. Examples of useful pigments include pigments such as photoluminescent pigment powder. The powder or pigments may comprise a phosphorescent material based on strontium oxide diluminate chemistry as identified in U.S. published application 2009/0262514. The photoluminescent matter may be a photoluminescent light green/light powder blue pigment powder such as that sold by Ambient Glow Technology of Canada.

The binder may include any film forming composition to which the pigment can be loaded and that will adhere to the substrate (i.e., the cured and/or uncured pavers). These binders form a matrix in which the pigment is evenly dispersed. The binder or matrix may include one or more polymers or polymer-forming constituents. For example, the matrix may include acrylics, acrylates, methacrylates, silicones, epoxies, polyureas, butyl rubber, neoprene, urethane, and polyurethanes. The binder may be an acrylic-based clear sealer such as that sold under the trade name Super Seal™ 2000 (Concrete Coatings, Inc.).

As defined herein, the term "clear" as used with the clear coat layer is defined as a material that can be seen through. The term "optically transmissive" as used herein is taken to mean transmissive to desired wavelengths of electromagnetic radiation such as in visible light. Generally transmissivities greater than 50 percent of visible light are contemplated with high transmissivities of greater than 90 percent being useful. The polymeric material of choice employed in the clear coat layer can be one that imparts suitable scratch and abrasion resistance as desired or required. As such, it is contemplated that the clear coat layer can include suitable abrasion resistance enhancing additives as would be known to the skilled artisan. It is also contemplated that the clear coat layer can include additives which impart ultraviolet resistance and resistance to other undesirable environmental factors. Once again, such additives are typically known to the skilled artisan.

It is contemplated that dispersion of the photoluminescent particulate pigment material is essentially uniform throughout the photoluminescent particulate pigment layer. As used herein, the term "essentially uniform" is taken to mean a dispersion of the particulate pigment material in a manner that exhibits minimal perceptible clumping or agglomeration of the particulate pigment.

It is further contemplated that the curable liquid coating composition is bonded to desired outer porous surfaces of the pavers. As used herein, the term "essentially permanent" is taken to mean that the pavers and overlying film material are integrally connected to one another throughout the life of the associated pavers.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of manufacturing photoluminescent pavers at a manufacturing facility, the method comprising:
- providing a curable paver composition;
- forming a plurality of uncured pavers from the curable paver composition, each of the pavers having an upper surface;
- applying a curable liquid coating composition to the upper surfaces, wherein the applying includes:
  - providing at least one spay nozzle,
  - spraying from the at least one nozzle each of the upper surfaces with a binder to form a film,
  - providing least one powder coating device,
  - spraying an air fluidized powder photoluminescent particulate pigment through the at least one powder coating device to the outer surface of each of the films, and
  - coating the photoluminescent particulate pigment on each of the films with an optically transmissive clear coat layer to form the curable liquid coating composition; and
- heating the uncured pavers in a kiln to form cured pavers wherein the applied liquid coating composition is substantially cured upon removal of the cured pavers from the kiln.

2. The method as claimed in claim 1, wherein the clear coat is a sealer.

3. The method as claimed in claim 1, wherein the binder is a sealer.

4. The method as claimed in claim 3, wherein the sealer is an acrylic-based clear sealer.

5. The method as claimed in claim 1 further comprising the step of providing a conveyor that carries the uncured pavers and wherein the step of applying is performed while the uncured pavers are carried by the conveyor.

6. The method as claimed in claim 1, wherein the at least one powder coating device includes at least one powder coating spray gun.

7. The method as claimed in claim 1, wherein the curable paver composition includes concrete.

8. The method of claim 1, wherein the photoluminescent pigment is generally uniformly dispersed in the binder.

9. A method of manufacturing both photoluminescent and non photoluminescent pavers, the method comprising:
- providing a curable paver composition;

forming first and second sets of uncured pavers from the curable paver composition, each of the uncured pavers having an upper surface;

applying a curable liquid coating composition to the upper surfaces of the first set of the uncured pavers, wherein the applying includes:

providing at least one spray nozzle, spraying from the at least one spray nozzle the upper surfaces of each of the first set of uncured pavers with a binder to form a film, providing at least one powder coating device, spraying an air fluidized powder photoluminescent particulate pigment through the at least one powder coating device to the outer surface of each of the films, and coating the photoluminescent particulate pigment on each of the films with an optically transmissive clear coat to form the curable liquid coating composition; and heating the second set of uncured pavers in the kiln to form cured non photoluminescent pavers.

10. The method as claimed in claim 9, wherein the clear coat is a sealer.

11. The method as claimed in claim 9, wherein the binder is a sealer.

12. The method as claimed in claim 11, wherein the sealer is an acrylic-based clear sealer.

13. The method as claimed in claim 9 further comprising the step of providing a conveyor that carries the first set of uncured pavers and wherein the step of applying is performed while the first set of uncured pavers are carried by the conveyor.

14. The method as claimed in claim 9, wherein the at least one powder coating device includes at least one powder coating spray gun.

15. The method as claimed in claim 9, wherein the curable paver composition includes concrete.

16. The method of claim 9, wherein the photoluminescent pigment is generally uniformly dispersed in the binder in the first set of uncured pavers.

* * * * *

UNITED STATES PATENT AND TRADEMARK OFFICE

CERTIFICATE OF CORRECTION

PATENT NO. : 8,617,638 B2
APPLICATION NO. : 12/766406
DATED : December 31, 2013
INVENTOR(S) : Dennis Michael Hill It is certified that error appears in the above-identified patent and that said Letters Patent is hereby corrected as shown below:

In the Claims

Column 8, Line 35, Claim 1:

After "providing" insert -- at --.

Signed and Sealed this
Twentieth Day of May, 2014

Michelle K. Lee

Michelle K. Lee
*Deputy Director of the United States Patent and Trademark Office*